US006009637A

United States Patent [19]

Pavone

[11] Patent Number: 6,009,637

[45] Date of Patent: Jan. 4, 2000

[54] HELIUM FOOTWEAR SOLE

[76] Inventor: Luigi Alessio Pavone, 1200 McKinney St #309, Houston, Tex. 77010

[21] Appl. No.: 09/033,277

[22] Filed: Mar. 2, 1998

[51] Int. Cl.[7] ..... A43B 13/20

[52] U.S. Cl. ..... 36/29; 36/28

[58] Field of Search ..... 36/29, 28, 3 R, 36/3 B

[56] References Cited

U.S. PATENT DOCUMENTS

| | | | |
|---|---|---|---|
| 3,795,994 | 3/1974 | Ava | 36/29 |
| 4,183,156 | 1/1980 | Rudy | 36/29 |
| 4,670,995 | 6/1987 | Huang | 36/29 |
| 4,887,367 | 12/1989 | Mackness et al. | 36/29 |
| 4,936,029 | 6/1990 | Rudy | 36/29 |
| 5,025,575 | 6/1991 | Lakic | 36/19 |
| 5,199,191 | 4/1993 | Moumdjian | 36/29 |
| 5,287,638 | 2/1994 | Preston | 36/29 |
| 5,313,717 | 5/1994 | Allen et al. | 36/29 |
| 5,363,570 | 11/1994 | Allen et al. | 36/29 |
| 5,425,184 | 6/1995 | Lyden et al. | 36/29 |
| 5,771,606 | 6/1998 | Litchfield et al. | 36/29 |

*Primary Examiner*—M D Patterson

[57] ABSTRACT

The Helium filled modules as described are simple and reliable. It includes an exterior surface, the body of the module itself, which will hold the helium. Within each module are partitions, with gaps in the walls. The purpose of the gaps is to equalize the pressure within the module, so that helium will be equally distributed within. The partitions will also provide structural support. The size of the modules which will occupy the sole of the shoe will vary according to shoe size. The modules will be placed throughout the sole, at the places where the instep, ball of the foot and heel will rest. The modules are designed to fit in the sole of the shoe. The sole of the shoe will be made of rubber. The rubber sole is inserted in a mold. The helium modules are placed on the rubber sole with adhesive to hold them in the desired place. Then, either polyurethane, phylan or EVA foam will be poured into the mold. Upon the foam hardening, the Helium modules will be held in place permanently.

4 Claims, 5 Drawing Sheets

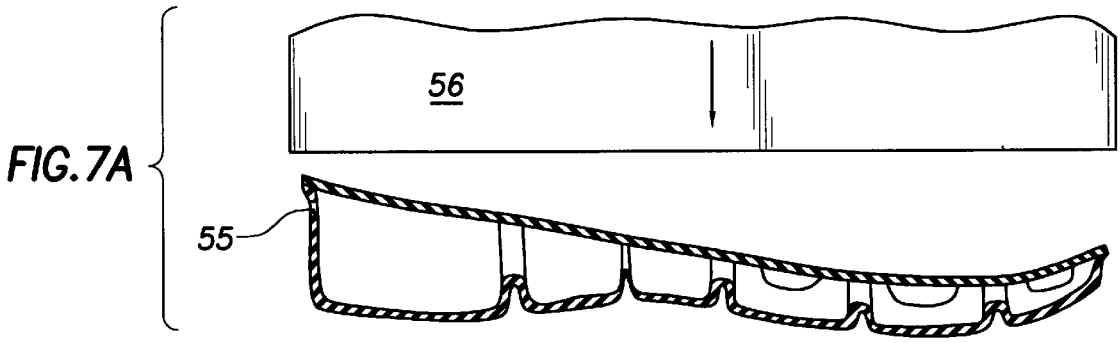
FIG. 7A
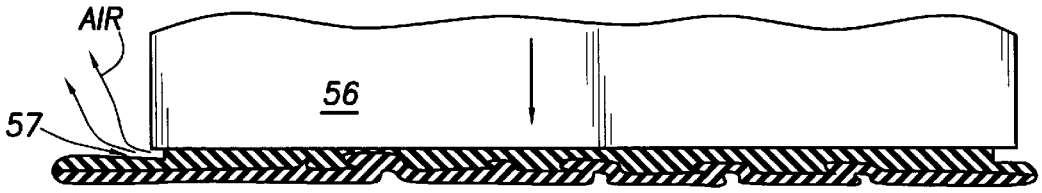
FIG. 7B
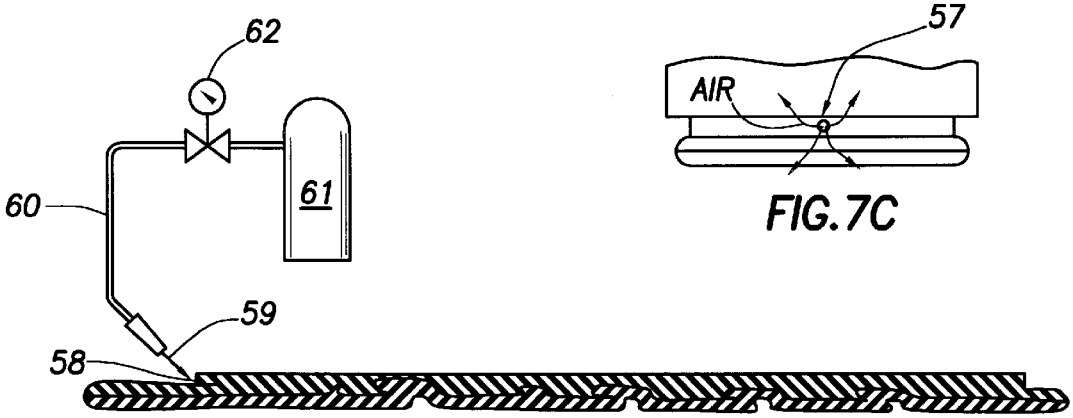
FIG. 7D
FIG. 7C
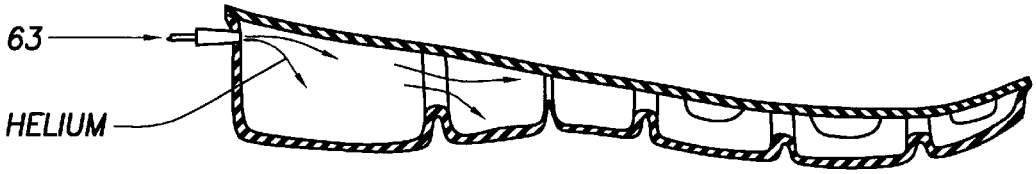
FIG. 7E

HELIUM FOOTWEAR SOLE

FIELD OF INVENTION

This invention relates to buoyancy and suspension devices in sport or athletic shoes.

BACKGROUND OF INVENTION

An athlete running and jumping on a surface will experience great stress to his or her feet, which in turn leads to fatigue and injuries to the foot. Support devices are also used to provide comfort for the wearer. Another purpose of support devices is to enhance performance of the wearer, since the wearer will be able to use the shoe to better advantage. Various devices have been used to provide support for the foot in an athletic setting, thus reducing fatigue and injury, comfort and enhance performance.

Accordingly, it is one of the objects of this invention is to provide a superior cushioning element, helium, in order to reduce injury and fatigue to the wearer.

Another object is to provide comfort to the wearer since helium will allow the sole of the shoe to better fit the foot.

Performance is also an object. Helium gas is lighter than any other support material, thus reducing the weight of the shoe, making it easier to run and jump.

It is also an object to provide support in the shoe which is easy and therefore economical to manufacture.

These and other objects, features and advantages of the invention will become apparent from the following description.

BRIEF DESCRIPTION OF DRAWINGS

These and other features of this invention will be better understood by reference to the detailed description of the preferred body of the invention, taken in conjunction with the accompanying drawings, in which:

FIG. 7 are several drawings indicating the molding process by which the helium modules core is made, and how the modules are inflated with helium.

DETAILED DESCRIPTION OF THE INVENTION

Figure 1:
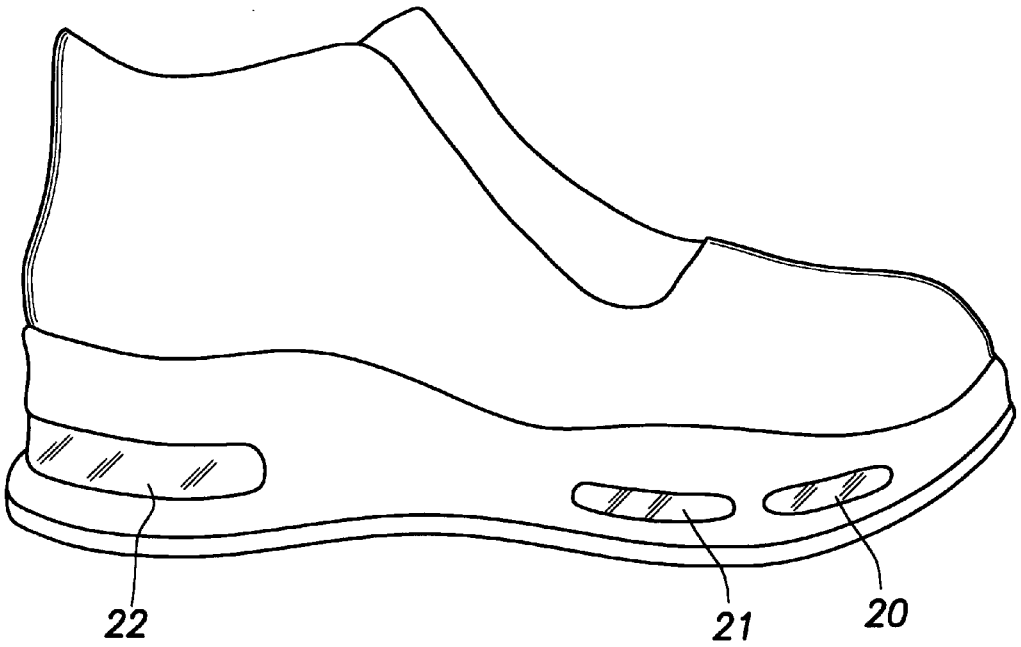
FIG. 1 is a side view of the shoe and sole as finished product. openings in the sole allow a view of the helium modules 20, 21, 22.
Figure 2:
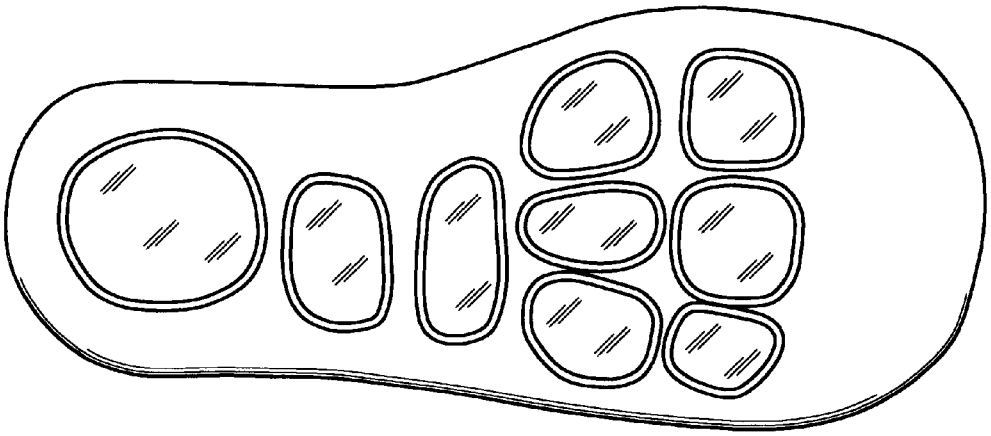
FIG. 2 is a bottom view of the sole of the shoe.
Figure 3:
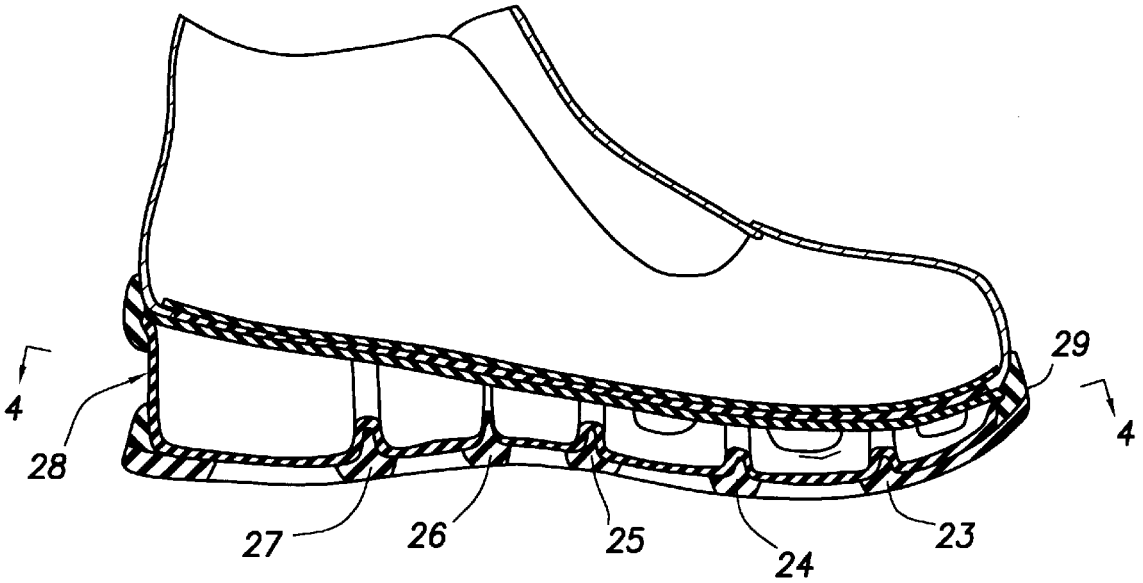
FIG. 3 is a cross section of the sole, taken along the axis described by line "A" in FIG. 4.
Figure 4:
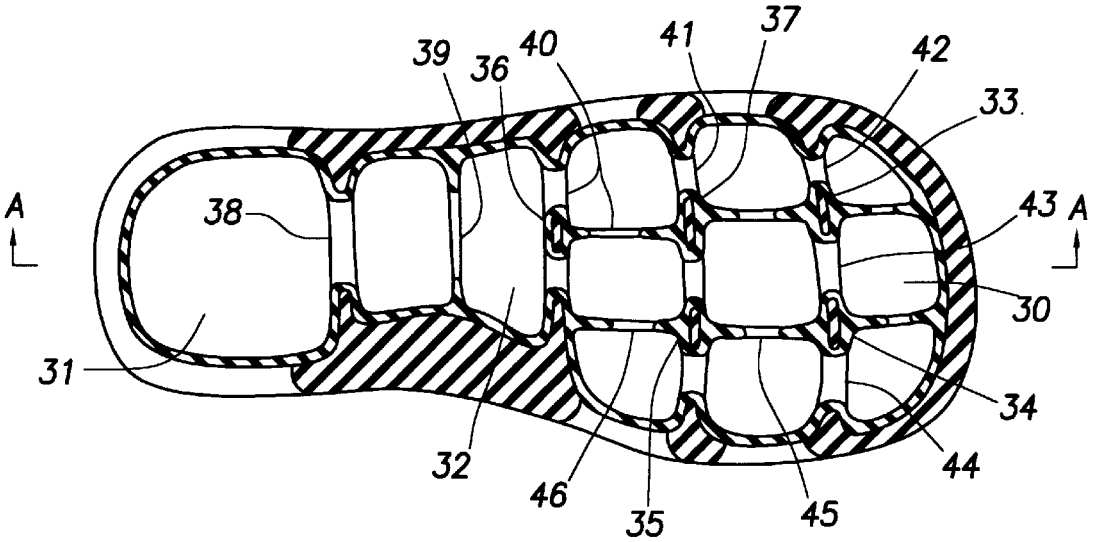
FIG. 4 is a top view of the sole, with all coverings removed, showing the braces between the helium modules.

Referring now to FIGS. 1 and 2, there is shown a preferred embodiment of the invention. Shown in FIG. 1 are openings in the sole 21, 22 where the helium modules are visible. FIG. 3 is a cross Section of FIG. 4, taken along the axis described by "A". Supports are indicated by 23, 24, 25, 26, 27. The purpose of these supports is to brace the helium modules and the sole. The exterior of the sole 28 also gives the helium modules shape. Also shown in FIG. 3 is the top cover of the sole 29, which is made of several layers of material, more specifically discussed in FIG. 5. FIG. 4 is a top view of the sole, with all covers removed, exposing the helium modules 30, 31, 32. The helium nodules constructed to the according to the present invention are shown. The Modules will be of different sizes to better accommodate the foot and its movements. The module at the ball of the foot 30 is divided into sections to accommodate the toes and ball of the foot. The modules at the instep will be straight along the outside of the foot with a curve on the inside to accommodate the inside curve of the foot and instep. The module at the heel 31 will be rounded in shape, since the heel of the foot is round. Referring to FIG. 4, within the modules will be support members 33, 34, 35, 36, 37 that have spaces between them 38, 39, 40, 41, 42, 43, 44, 45, 46. These spaces allow the pressure inside the module to equalize as the foot presses against the different parts of the shoe. As the wearer turns, pivots or places pressure forwards or backwards on the shoe, the helium gas on the module receiving the pressure will be compressed. The spaces allow the helium to escape into another chamber in the module, which can accept the incoming helium. Once the pressure is relieved, the expanded chamber will release the gas, which will travel into the chamber that was formerly compressed. Thus, the spaces in the supports serve to equalize pressure. A distinct advantage for the wearer of the shoe is that the sole will mold itself to the foot, for better interaction with the surface the wearer is on. The support members will be constructed from hard rubber to provide support and to direct helium gas into the openings provided. The helium modules will rest within the support braces, however, the support members will not touch the top of the module FIG. 3, 47 to allow for compression of the sole. Compression is necessary so the sole may mold itself to the foot as the wearer moves in different directions. The advantage of this feature is that the sole will provide better traction.

Figure 5:
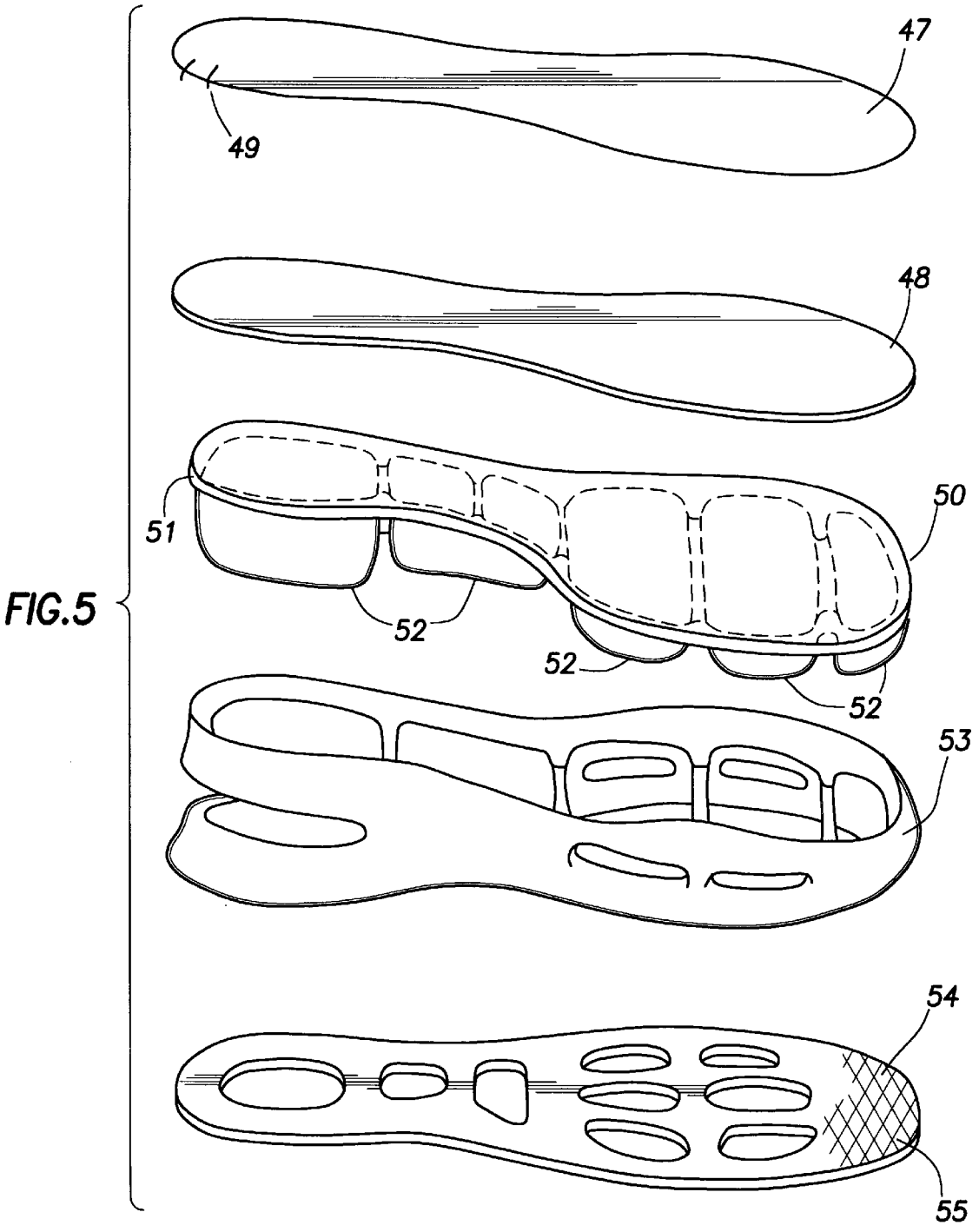
FIG. 5 is a an exploded view the sole and sole covering materials.
Figure 6:
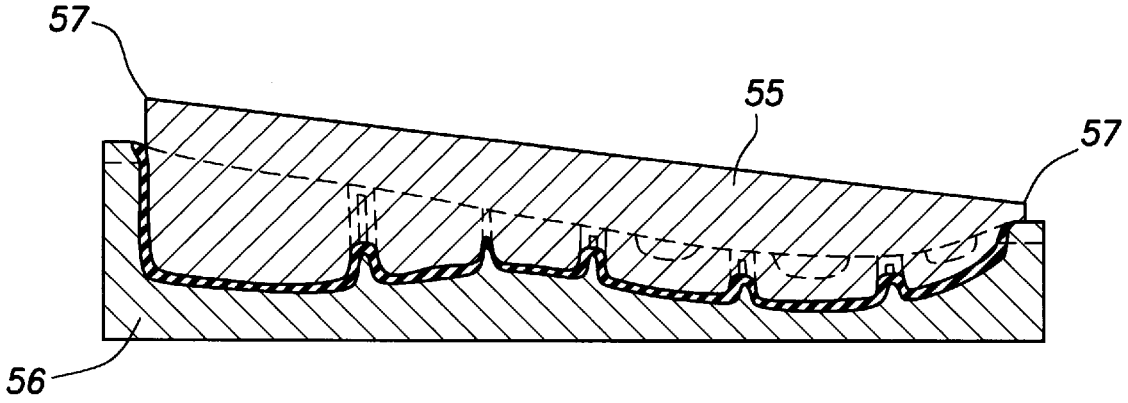
FIG. 6 is a cross section of the mold used to make the top cover and attach the modules.
Figure 8:
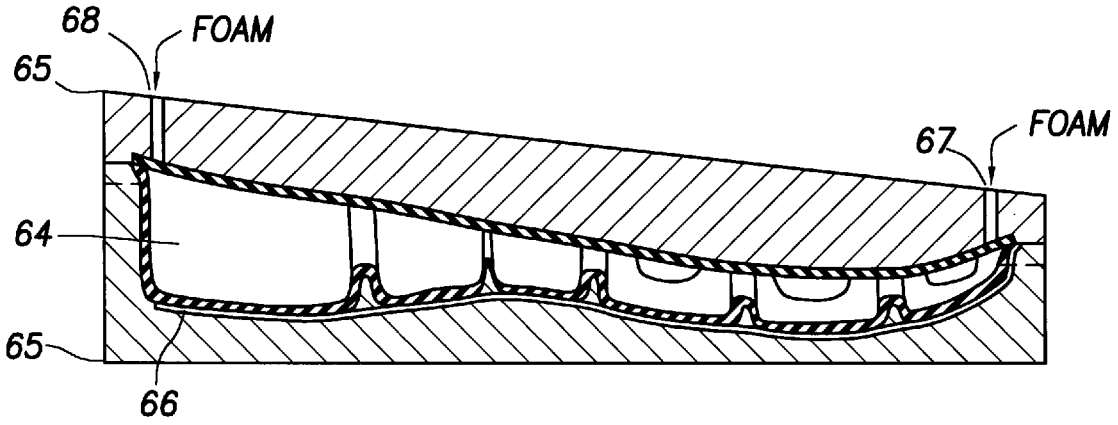
FIG. 8 indicates the process by which the helium modules core and the foam rubber core are molded.

The different materials and their arrangement are illustrated in FIG. 5. the top cover material, which contacts the wearer's foot, is a terry cloth inner sole 47. Beneath the terry cloth inner sole is an inner sole made of neoprene material 48 which cushions the foot. The terry cloth and neoprene soles are attached by stitches 49. Beneath the neoprene inner sole is the helium modules core 50 which consists of a top cover 51 and helium modules 52. The helium modules core 50 fits within the molding of the sole, which is made in a mold, as discussed in the explanation of FIG. 8, of rubber foam. Finally, the hard rubber bottom sole, 54, is attached to the bottom of the sole with adhesive 55. Although FIG. 5, at 55 only shows adhesive at the front of the sole the adhesive is applied throughout the bottom sole 54.

The process by which the modules will be filled with helium is as follows. The modules will be molded from silicone material. Then, top cover of the helium modules core will be attached with adhesive to the modules 55. A press 56 will then press the helium modules core forcing the air to escape through an opening at the rear of the helium modules core 57. Since all chambers of the helium modules core are interconnected, this process will force all air out. In order to re-inflate the helium modules core with helium a self sealing valve will be used 58. Helium is inserted through a needle valve 59, which is attached to a hose 60. The hose emanates from a helium canister 61. There is a valve with a meter 62 attached between the hose and the canister which regulates the amount of helium to the desired pressure. The helium going into the modules will re-inflate the helium modules core, since the pressure from the press will be released as the helium enters the modules 63.

Once the helium modules core has been constructed, it will be placed 64 into a hard plastic mold 65, of the desired sole shape. The hard rubber sole 66 will be in the mold before the helium modules core is inserted 65. The hard rubber sole will be attached to the helium modules core with adhesive 66. Foam rubber will be poured in liquid form into the mold through top openings 67, 68. The foam will become solid inside the mold. The walls of the mold will be coated with release wax to prevent the foam rubber from adhering to it. Any foam that overflows through the fill holes will be trimmed off, level with the top of the sole.

I claim:

1. A footwear sole comprising of:

a mid-sole of a helium modules core which is made of silicone material; is transparent; is comprised of several interconnected modules; is covered on top by a terry cloth and neoprene inner sole or liner which are stitched together; is supported and shaped on the bottom by a rubber bottom sole; and permanently attached to the rubber bottom sole by a layer of rubber foam: a plurality of hard support members with spaces between them are located between modules, said support members are held in shape and braced from the bottom by the rubber bottom sole, and said support members do not connect to a top of the helium module core.

2. Said footwear sole of claim 1, where:

said helium modules core mid-sole is comprised of several interconnected modules comprised of modules of varying sizes to accommodate the toes and the ball of the foot and instep modules where the modules at the instep are straight along a lateral side of the mid-sole to follow and accommodate the contour of the outside of the foot and curved along a medial side of the mid-sole to follow and accommodate the inside curve of the foot and instep; and a heel module where the module at the heel is rounded in shape and all said modules are filled with helium.

3. Said footwear sole of claim 2 where, said mid-sole is comprised of a top cover and the helium modules core.

4. Said footwear sole of claim 3 further comprising, a self-sealing valve in said helium modules core mid-sole to inflate said mid-sole with the helium.

* * * * *